US008505475B2

(12) United States Patent
Otsuka et al.

(10) Patent No.: US 8,505,475 B2
(45) Date of Patent: Aug. 13, 2013

(54) PERSONAL WATERCRAFT

(75) Inventors: Kenichi Otsuka, Shizuoka (JP); Yoshiyuki Kaneko, Shizuoka (JP); Sumihiro Takashima, Shizuoka (JP)

(73) Assignee: Yamaha Hatsudoki Kabushiki Kaisha, Shizuoka (JP)

( * ) Notice: Subject to any disclaimer, the term of this patent is extended or adjusted under 35 U.S.C. 154(b) by 243 days.

(21) Appl. No.: 13/070,642

(22) Filed: Mar. 24, 2011

(65) Prior Publication Data

US 2012/0180710 A1 Jul. 19, 2012

(30) Foreign Application Priority Data

Jan. 17, 2011 (JP) ..... 2011-006908

(51) Int. Cl.
*B63B 35/73* (2006.01)

(52) U.S. Cl.
USPC ..... 114/55.5; 440/1

(58) Field of Classification Search
USPC ..... 114/55.5, 55.51, 55.53, 55.55; 440/1
See application file for complete search history.

(56) References Cited

U.S. PATENT DOCUMENTS

| | | | | |
|---|---|---|---|---|
| 5,941,188 | A | 8/1999 | Takashima et al. | |
| 6,276,290 | B1 * | 8/2001 | Yamada et al. | 114/55.51 |
| 6,530,336 | B2 * | 3/2003 | Ibata et al. | 114/55.5 |
| 6,626,124 | B2 * | 9/2003 | Nakajima et al. | 114/55.53 |
| 6,758,703 | B2 | 7/2004 | Funayose et al. | |
| 7,017,507 | B2 * | 3/2006 | Hattori et al. | 114/55.52 |
| 2005/0235894 | A1 | 10/2005 | Hattori et al. | |

FOREIGN PATENT DOCUMENTS

| | | | |
|---|---|---|---|
| JP | 09-277988 | A | 10/1997 |
| JP | 2000-103389 | A | 4/2000 |
| JP | 2003-089392 | A | 3/2003 |
| JP | 2005-306314 | A | 11/2005 |

* cited by examiner

*Primary Examiner* — Lars A Olson
(74) *Attorney, Agent, or Firm* — Keating & Bennett, LLP

(57) ABSTRACT

A personal watercraft includes a hull, a deck, a steering handle, a steering shaft, a seat, and a display device. The deck is disposed above the hull. The steering handle is disposed above the deck. The steering shaft is arranged to extend downward from the steering handle. The display device includes a display portion and a switch. The display portion is disposed forward relative to the steering shaft. The switch is arranged to operate the display portion. The switch is disposed on a surface of the deck rearward relative to the steering shaft and forward relative to a central front end of the seat.

10 Claims, 10 Drawing Sheets

PERSONAL WATERCRAFT

BACKGROUND OF THE INVENTION

1. Field of the Invention

The present invention relates to a personal watercraft.

2. Description of the Related Art

A personal watercraft including a display portion that displays information such as a speed is known.

The conventional personal watercraft described in U.S. Pat. No. 6,758,703 includes a display panel disposed in front of the steering handle and an operation switch that switches the display on the display panel. The operation switch is disposed on the lateral side of the display panel.

On the other hand, the conventional personal watercraft described in Japanese Published Unexamined Patent Application No. H09-277988 includes a display meter disposed in front of the steering handle and a changeover switch that switches the display on the display meter. The changeover switch is disposed on a grip portion of the steering handle.

SUMMARY OF THE INVENTION

The inventors of preferred embodiments of the present invention described and claimed in the present application conducted an extensive study and research regarding a personal watercraft, such as the ones described above, and in doing so, discovered and first recognized new unique challenges and previously unrecognized possibilities for improvements as described in greater detail below.

In detail, when a plurality of personal watercrafts are transported, these personal watercrafts may be transported in a state in which they are housed in a rectangular parallelepiped container in some cases. Specifically, for example, each personal watercraft is disposed inside a rectangular parallelepiped packaging frame. Then, a plurality of packaging frames housing personal watercrafts are housed in a rectangular parallelepiped container, and this container is transported by a transportation device such as a vessel.

The size of the container is normally determined. Therefore, the size of the packaging frame is set so that, for example, four packaging frames arranged up and down and right and left can be housed in one container for effective use of the space inside the container (for example, refer to FIG. 10). Therefore, the width of the packaging frame may be smaller than the width of the personal watercraft. In this case, in a state in which, for example, the steering handle is removed and the personal watercraft is inclined in the right-left direction, the personal watercraft is disposed inside the packaging frame (for example, refer to FIG. 9). Accordingly, the personal watercraft is efficiently housed inside the packaging frame.

The display portion arranged to display information such as a speed is disposed in front of the steering handle. When the personal watercraft is disposed inside the packaging frame in a state in which it is inclined in the right-left direction, the display portion is disposed inside the corner portion of the packaging frame (for example, refer to FIG. 9). Therefore, if the width of the display portion is wide, the personal watercraft may not be efficiently housed inside the packaging frame. Therefore, the width of the display portion is preferably small.

However, in the conventional personal watercraft described in U.S. Pat. No. 6,758,703, the operation switch is disposed on the lateral side of the display panel. Therefore, the total width including the display panel and the operation switch, that is, the width of the display portion, increases.

Therefore, the personal watercraft may not be efficiently housed inside the packaging frame.

The conventional personal watercraft described in Japanese Published Unexamined Patent Application No. H09-277988 is provided with a changeover switch on the steering handle. The personal watercraft may be disposed inside the packaging frame in a state in which the steering handle is removed. Therefore, in this case, before the personal watercraft is transported, a process for removing wiring that connects the changeover switch and the display portion is necessary, and after the personal watercraft is transported, a process for connecting the changeover switch and the display portion by wiring is necessary. Therefore, the processes accompanying transportation of the personal watercraft increase.

In order to overcome the previously unrecognized and unsolved challenges described above, a preferred embodiment of the present invention provides a personal watercraft including a hull, a deck, a steering handle, a steering shaft, a seat, and a display device. The deck is disposed above the hull. The steering handle is disposed above the deck. The steering shaft is arranged to extend downward from the steering handle. The seat includes a central front end that is the front end of a center in a width direction. The seat is supported on the deck rearward relative to the steering shaft. The display device includes a display portion and a switch. The display portion is disposed forward relative to the steering shaft. The switch is arranged to operate the display portion. The switch is disposed on a surface of the deck rearward relative to the steering shaft and forward relative to the central front end of the seat.

With this arrangement of the present preferred embodiment of the present invention, the display portion that displays information of the personal watercraft is disposed forward relative to the steering shaft. Therefore, the display portion is disposed at a position to be easily viewed by a driver sitting on the seat. Accordingly, viewing ease of the display portion is secured. The switch arranged to operate the display portion is disposed rearward relative to the steering shaft. Therefore, as compared with the case in which the switch is disposed on the lateral side of the display portion, the width of the display portion can be reduced. Accordingly, even when the personal watercraft is housed inside a packaging frame in a state in which the personal watercraft is inclined in the right-left direction, the personal watercraft can be efficiently housed inside the packaging frame. The switch is disposed on the surface of the deck forward relative to the central front end of the seat. Specifically, the switch is disposed by the hand of a driver. Therefore, a driver can easily access the switch.

The deck may include an article storing portion that is disposed rearward relative to the switch and forward relative to the central front end of the seat.

With this arrangement of the present preferred embodiment of the present invention, the article storing portion is disposed rearward relative to the steering shaft. Therefore, a dead space is defined between the steering shaft and the article storing portion. The switch is disposed in the dead space on the deck. Accordingly, the dead space is effectively used. Further, the article storing portion is disposed forward relative to the central front end of the seat, so that a driver can easily access the article storing portion.

The display device may further include a wiring arranged to connect the display portion and the switch. The wiring may be covered by the deck in a state that the wiring does not contact movable portions of the personal watercraft that are movable with respect to the deck, and the wiring is attached to the deck. The movable portions may include at least one of the steering handle and the steering shaft. Further, the movable portions may include a steering column that holds the steering shaft.

With this arrangement of the present preferred embodiment of the present invention, the wiring is covered by the deck in a state that the wiring does not contact with the movable portions movable with respect to the deck. The wiring and the movable portions are not in contact with each other, so that the wiring can be prevented from being damaged due to rubbing of the movable portions against the wiring. Further, the wiring is attached to the deck. As described above, the switch is disposed on the surface of the deck. Specifically, both of the wiring and the switch are attached to the deck. Therefore, when the movable portions, such as the steering handle, are removed from the personal watercraft, the wiring does not need to be removed. Therefore, when the personal watercraft is transported in a state in which the movable portions are removed, it is not necessary to remove the wiring. Accordingly, processes required for transporting the personal watercraft can be reduced.

The personal watercraft may further include a visor arranged to cover the display portion. The visor may have a shape that extends along a corner portion of the packaging frame when the personal watercraft, in a packaging state in which the personal watercraft is housed in a rectangular parallelepiped packaging frame, is viewed from a front of the personal watercraft. With this arrangement of the present preferred embodiment of the present invention, the space inside the packaging frame is effectively used, and the personal watercraft is efficiently housed inside the packaging frame.

The switch may be disposed so as to face upward or backward. As described above, the switch is disposed on the surface of the deck. Therefore, a driver looks down on the switch. With this arrangement of the present preferred embodiment of the present invention, the switch is disposed so as to face upward or backward, so that a driver easily looks at the switch and easily operates the switch.

The steering handle may be arranged to turn up and down around a tilt shaft. The personal watercraft may further include a tilting operation lever arranged movably between a locked position at which turning of the steering handle around the tilt shaft is locked and an unlocked position at which a lock of the steering handle around the tilt shaft is released. The tilting operation may be disposed rearward relative to the steering shaft and forward relative to the central front end of the seat. In this case, the switch may be disposed on a lateral side of the tilting operation lever.

With this arrangement of the present preferred embodiment of the present invention, the steering handle is arranged to turn up and down around the tilt shaft, and the tilting operation lever that moves between a locked position and an unlocked position is disposed rearward relative to the steering shaft and forward relative to the central front end of the seat. The switch is disposed on the lateral side of the tilting operation lever. Specifically, the switch is disposed in a dead space on the lateral side of the tilting operation lever. Accordingly, the dead space is effectively used.

The above and other elements, features, steps, characteristics and advantages of the present invention will become more apparent from the following detailed description of the preferred embodiments with reference to the attached drawings.

DETAILED DESCRIPTION OF THE PREFERRED EMBODIMENTS

Hereinafter, a personal watercraft in a reference posture will be described. The reference posture is a posture in which the personal watercraft floats in static water (water that stands still and does not move). FIGS. 1 to 7 show a personal watercraft in the reference posture.

Figure 1:
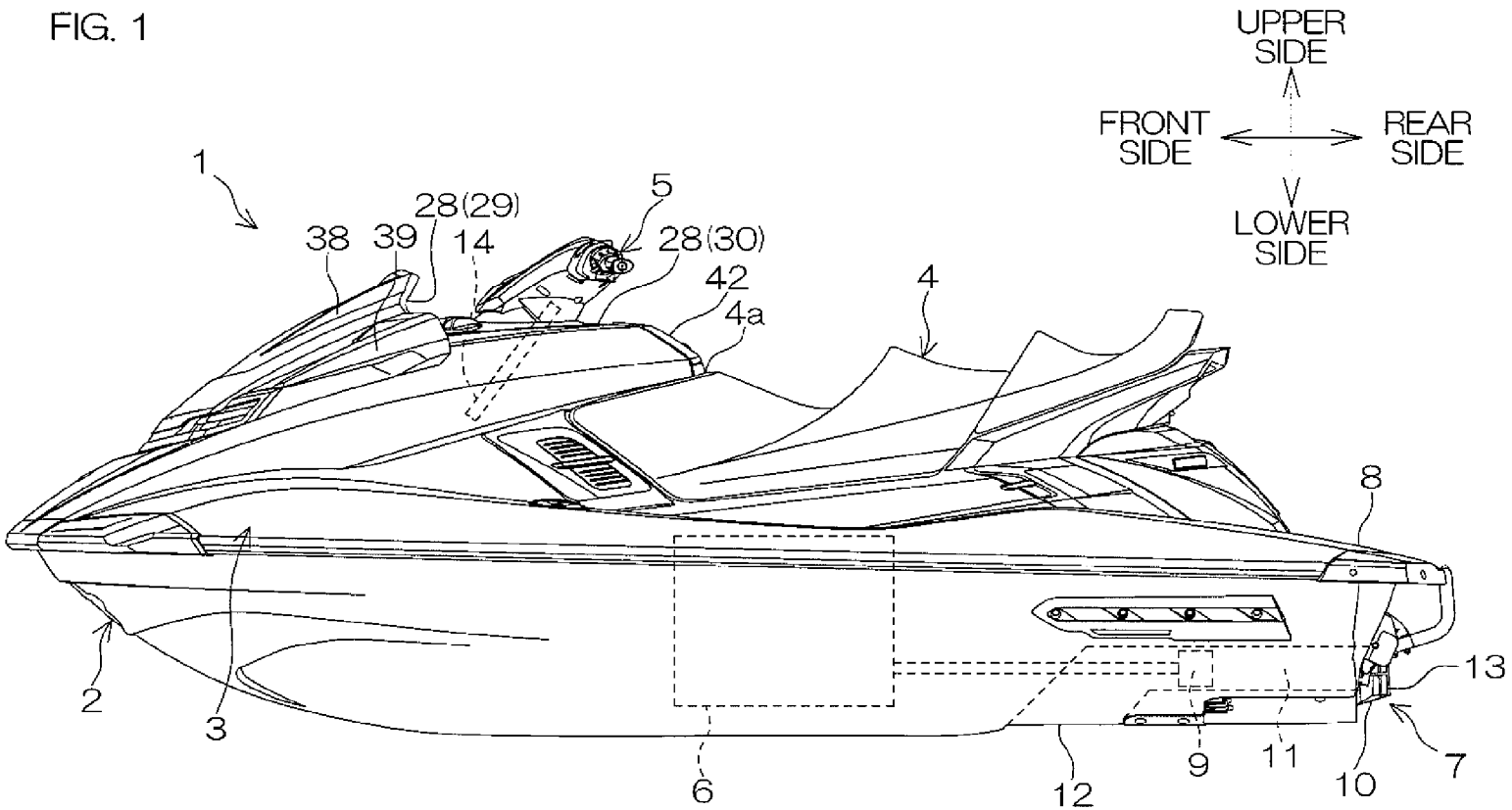
FIG. 1 is a side view of a personal watercraft according to a first preferred embodiment of the present invention.
Figure 2:
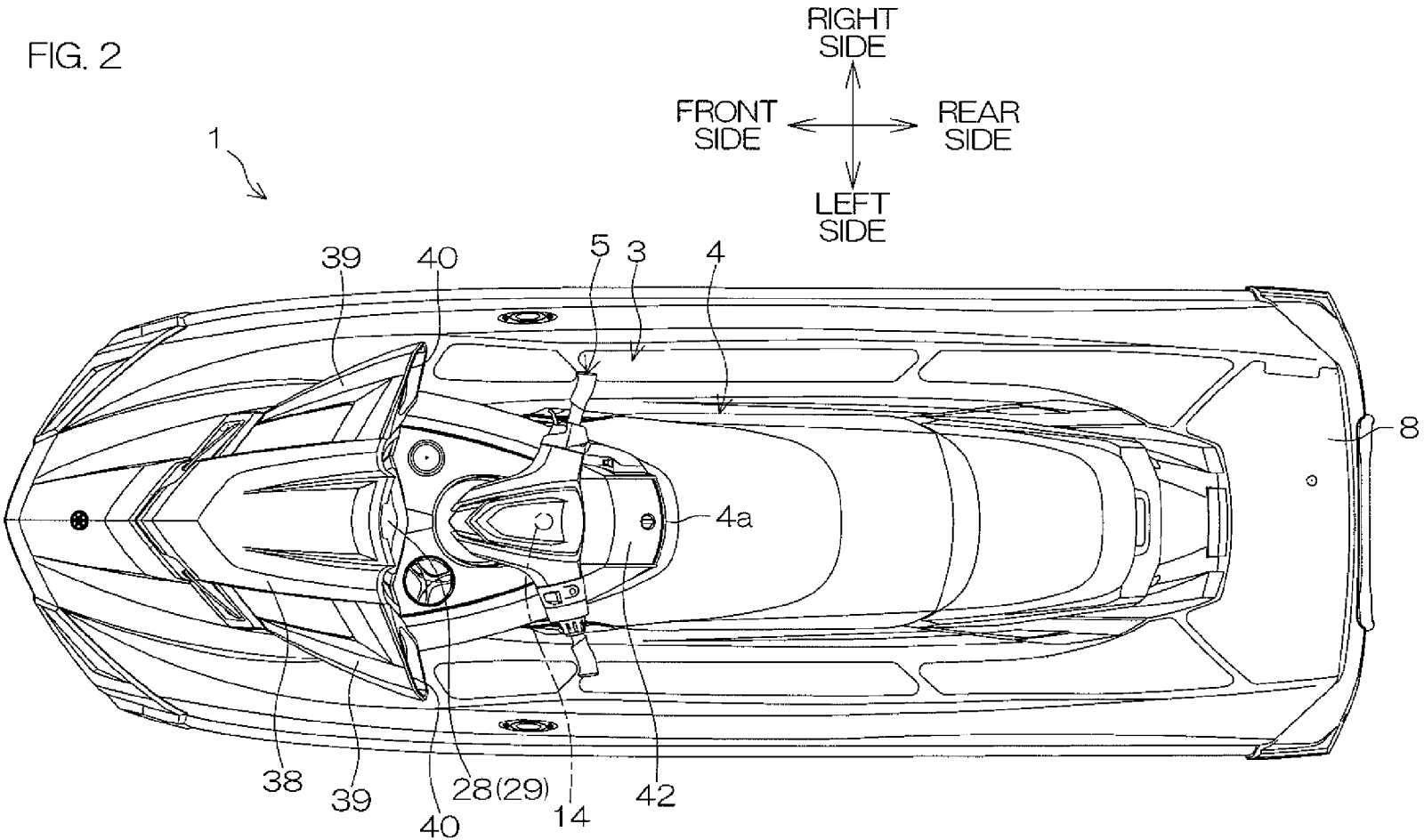
FIG. 2 is a plan view of the personal watercraft according to the first preferred embodiment of the present invention.

FIG. 1 is a side view of a personal watercraft 1 according to a first preferred embodiment of the present invention. FIG. 2 is a plan view of the personal watercraft 1 according to the first preferred embodiment of the present invention.

As shown in FIG. 1, the personal watercraft 1 includes a hull 2, a deck 3, a seat 4, and a steering handle 5. The deck 3 is disposed above the hull 2. The seat 4 and the steering handle 5 are disposed above the deck 3. The seat 4 and the steering handle 5 are supported on the deck 3. As shown in FIG. 2, the seat 4 and the steering handle 5 are disposed at the central portion of the personal watercraft 1 in the width direction (right-left direction). The seat 4 is disposed rearward relative to the steering handle 5. The seat 4 is disposed at the rear of the steering handle 5. The seat 4 extends in the front-rear direction in a plan view. The seat 4 is attached to the deck 3. The seat 4 is removable from the deck 3.

As shown in FIG. 1, the personal watercraft 1 further includes an engine 6 and a jet pump 7. The engine 6 is disposed inside the hull 2. The jet pump 7 is disposed at the rear portion of the hull 2. The engine 6 is disposed forward relative to the jet pump 7. The seat 4 is disposed above the engine 6. The deck 3 includes a platform 8 disposed at the stern of the personal watercraft 1. The jet pump 7 is disposed below the platform 8. The jet pump 7 is driven by the engine 6.

The jet pump 7 is arranged to generate a propulsive force by jetting water suctioned from below rearward. In detail, as shown in FIG. 1, the jet pump 7 includes an impeller 9 joined to the engine 6 and a deflector 10 disposed at the rear of the impeller 9. The impeller 9 is disposed in a flow passage 11 provided inside the personal watercraft 1. A first end portion of the flow passage 11 defines an intake 12 opened at the bottom surface of the hull 2, and a second end portion of the flow passage 11 defines an outlet 13 opened at the deflector 10. The deflector 10 is arranged to turn to the right or left according to an operation of the steering handle 5.

When the impeller 9 is driven to rotate by the engine 6, water is suctioned from the intake 12 into the flow passage 11. Then, water suctioned into the flow passage 11 is jetted from the outlet 13. Accordingly, a propulsive force is generated to propel the personal watercraft 1. When the steering handle 5 is operated, the direction of the deflector 10 changes, and the jetting direction of water from the deflector 10 changes. Therefore, the steering handle 5 is arranged to change the jetting direction of water from the jet pump 7. The personal watercraft 1 is steered by operations of the steering handle 5.

Figure 3:
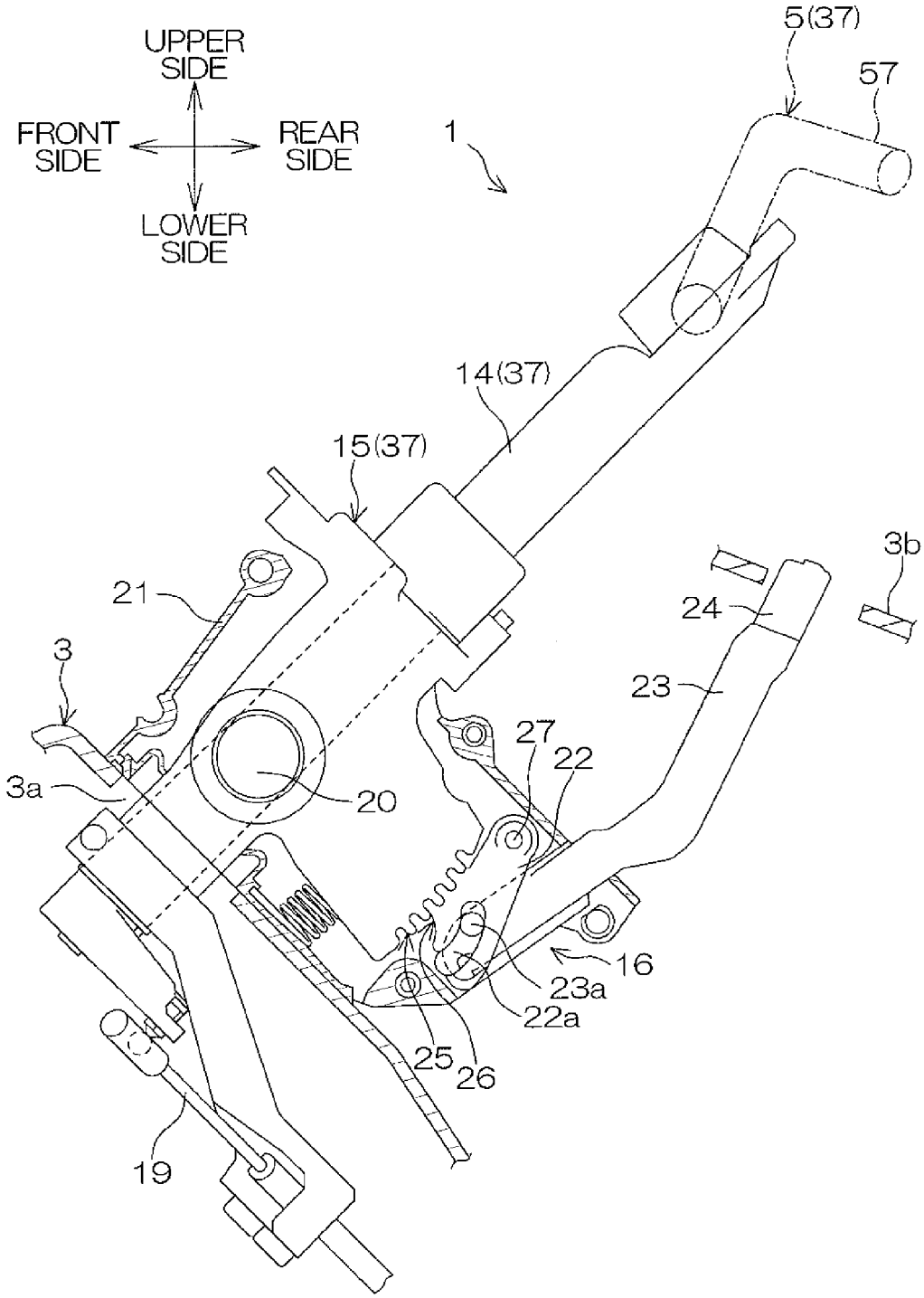
FIG. 3 is a view for describing a steering shaft according to the first preferred embodiment of the present invention and an arrangement relating to the same.

FIG. 3 is a view for describing a steering shaft 14 according to a first preferred embodiment of the present invention and an arrangement relating to the same.

The personal watercraft 1 includes a steering shaft 14, a steering column 15, and a tilt mechanism 16. The steering handle 5 includes a handle bar 57 and a handle cover 18 covering a portion of the handle bar 57 (refer to FIG. 4). The steering shaft 14 extends forward to the lower side from the handle bar 57. The seat 4 is supported on the deck 3 rearward relative to the steering shaft 14 (refer to FIG. 1). The upper end portion of the steering shaft 14 is joined to the steering handle 5, and the lower end portion of the steering shaft 14 is joined to the deflector 10 via a wire 19. A portion of the steering shaft 14 is housed inside the steering column 15. The steering column 15 holds the steering shaft 14 rotatably around the central axis of the steering shaft 14. The tilt mechanism 16 holds the steering column 15. Therefore, the steering handle 5 and the steering shaft 14 are held by the tilt mechanism 16 via the steering column 15.

The steering column 15 includes two tilt shafts 20 provided on the right and left sides of the steering column 15. The two tilt shafts 20 are disposed along a common axis extending horizontally. The tilt mechanism 16 holds the two tilt shafts 20. The tilt mechanism 16 holds the steering column 15 turnably within a predetermined angle range around the tilt shafts 20. The steering handle 5 and the steering shaft 14 rotate around the tilt shafts 20 together with the steering column 15. Therefore, when the steering column 15 turns around the tilt shafts 20, the tilt angle of the steering shaft 14 with respect to a horizontal plane changes. Accordingly, the steering handle 5 moves up or down and the position of the steering handle 5 changes.

The tilt mechanism 16 includes a housing 21, a stopper 22, an arm 23, and a tilting operation lever 24. The housing 21 is disposed inside the deck 3. The housing 21 is fixed to the deck 3. The stopper 22 is disposed inside the housing 21. The arm 23 is held by the housing 21 in a state in which a portion of the arm 23 projects upward from the housing 21. The tilting operation lever 24 is joined to the upper end portion of the arm 23. The housing 21 houses a portion of the steering column 15. Specifically, the upper end portion of the steering column 15 projects upward from the housing 21, and the lower end portion of the steering column 15 projects downward from the housing 21. Further, the lower end portion of the steering column 15 projects downward from an opening 3*a* provided on the deck 3. The steering column 15 is disposed inside the deck 3.

The steering column 15 includes a first gear 25 disposed inside the housing 21. Similarly, the stopper 22 includes a second gear 26 disposed inside the housing 21. The second gear 26 is disposed at the rear of the first gear 25. The first gear 25 and the second gear 26 are engaged with each other. Turning of the steering handle 5 around the tilt shafts 20 is locked by engagement between the first gear 25 and the second gear 26. In detail, the housing 21 includes a support shaft 27 extending in the right-left direction. The upper end portion of the stopper 22 is joined to the support shaft 27. The stopper 22 is supported rotatably around the support shaft 27 by the support shaft 27. Further, the stopper 22 has a groove 22*a* extending upward from the lower end portion of the stopper 22. The arm 23 includes a pin 23*a* disposed in the groove 22*a*. The arm 23 is held by the housing 21 so as to be movable up and down. Therefore, the arm 23 and the tilting operation lever 24 are movable up and down with respect to the housing 21. The pin 23*a* is disposed in the groove 22*a*, so that when the arm 23 moves up and down, the stopper 22 turns around the support shaft 27.

The steering handle 5 is arranged turnable up and down around the tilt shafts 20. The tilting operation lever 24 is movable between a locked position (position shown by the solid lines in FIG. 3) and an unlocked position (position higher than the locked position). The locked position is a position at which the first gear 25 and the second gear 26 engage with each other and turning of the steering handle 5 around the tilt shafts 20 is locked. The locked position is set so that, for example, the upper end portion of the tilting operation lever 24 is positioned at substantially the same position as that of the surface 3*b* of the deck 3. The unlocked position is a position at which the second gear 26 is disengaged from the first gear 25 and the lock of the steering handle 5 around the tilt shaft 20 is released. The tilting operation lever 24 is held at the locked position by a spring (not shown). The tilting operation lever 24 moves from the locked position to the unlocked position by being operated by a driver sitting on the seat 4.

In detail, when the tilting operation lever 24 is pulled up by a driver, the tilting operation lever 24 moves from the locked position to the unlocked position. According to the movement of the tilting operation lever 24 toward the unlocked position, the stopper 22 is pulled by the pin 23*a* and turns rearward around the support shaft 27. Accordingly, the second gear 26 is disengaged from the first gear 25 and the lock of the steering handle 5 is released. The position of the steering handle 5 is adjusted in a state in which the tilting operation lever 24 is held at the unlocked position. Then, when the driver releases the tilting operation lever 24, due to resilience of the spring (not shown), the tilting operation lever 24 returns to the locked position, and turning of the steering handle 5 around the tilt shafts 20 is locked. Accordingly, the steering handle 5 is held at the predetermined position.

Figure 4:
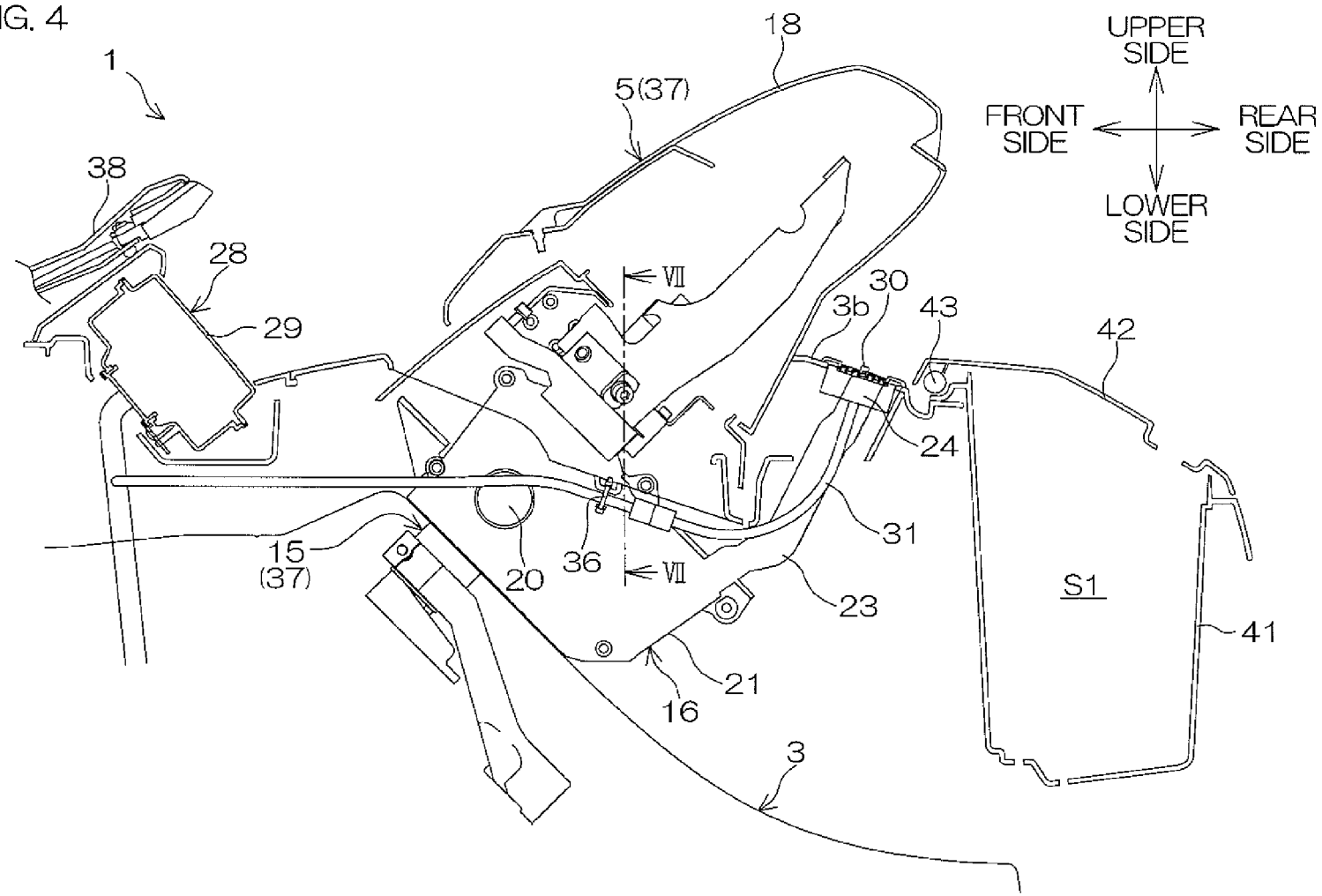
FIG. 4 is a view for describing an internal structure of the personal watercraft according to the first preferred embodiment of the present invention.
Figure 5:
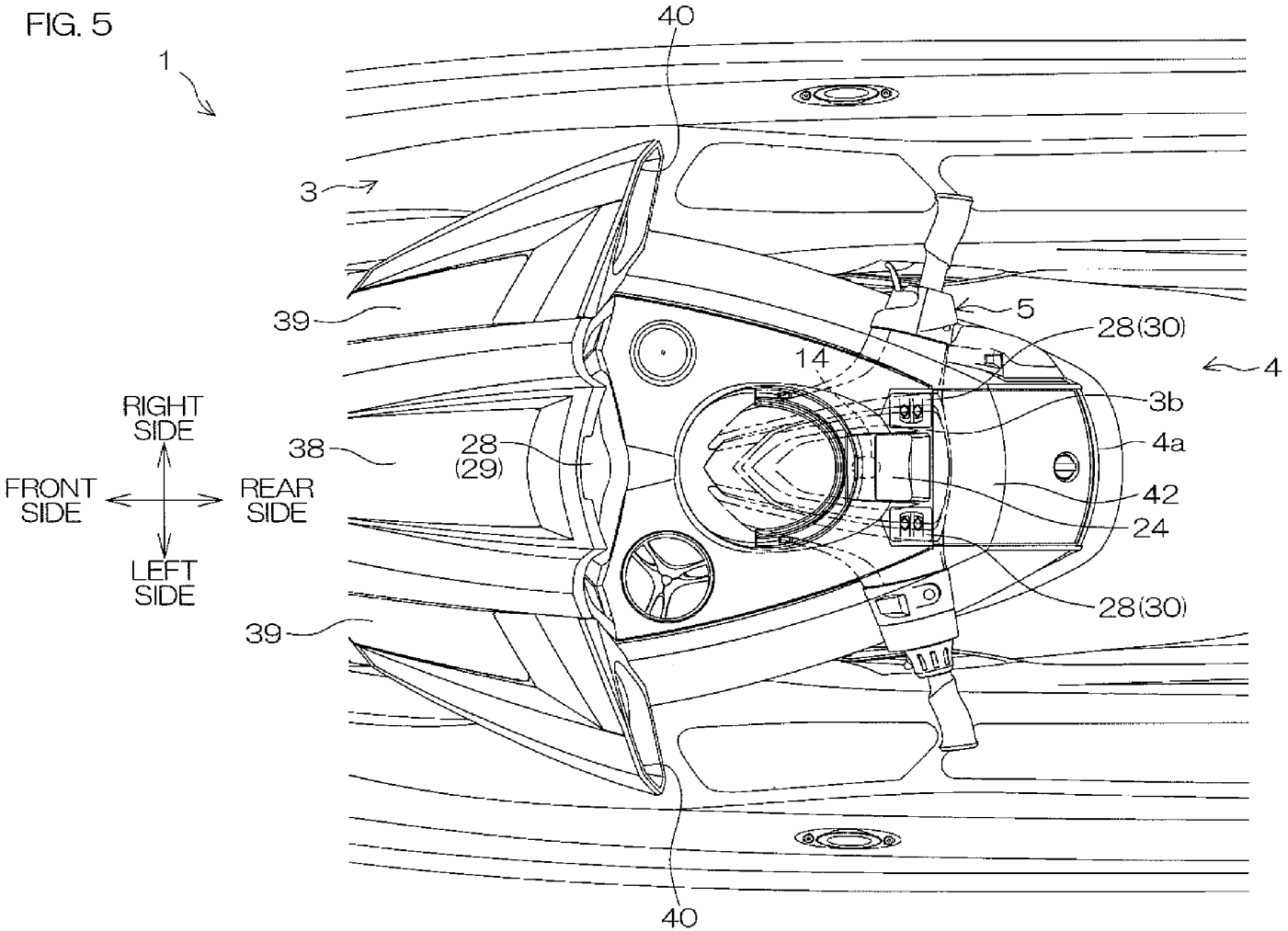
FIG. 5 is a plan view of a portion of the personal watercraft according to the first preferred embodiment of the present invention.
Figure 6:
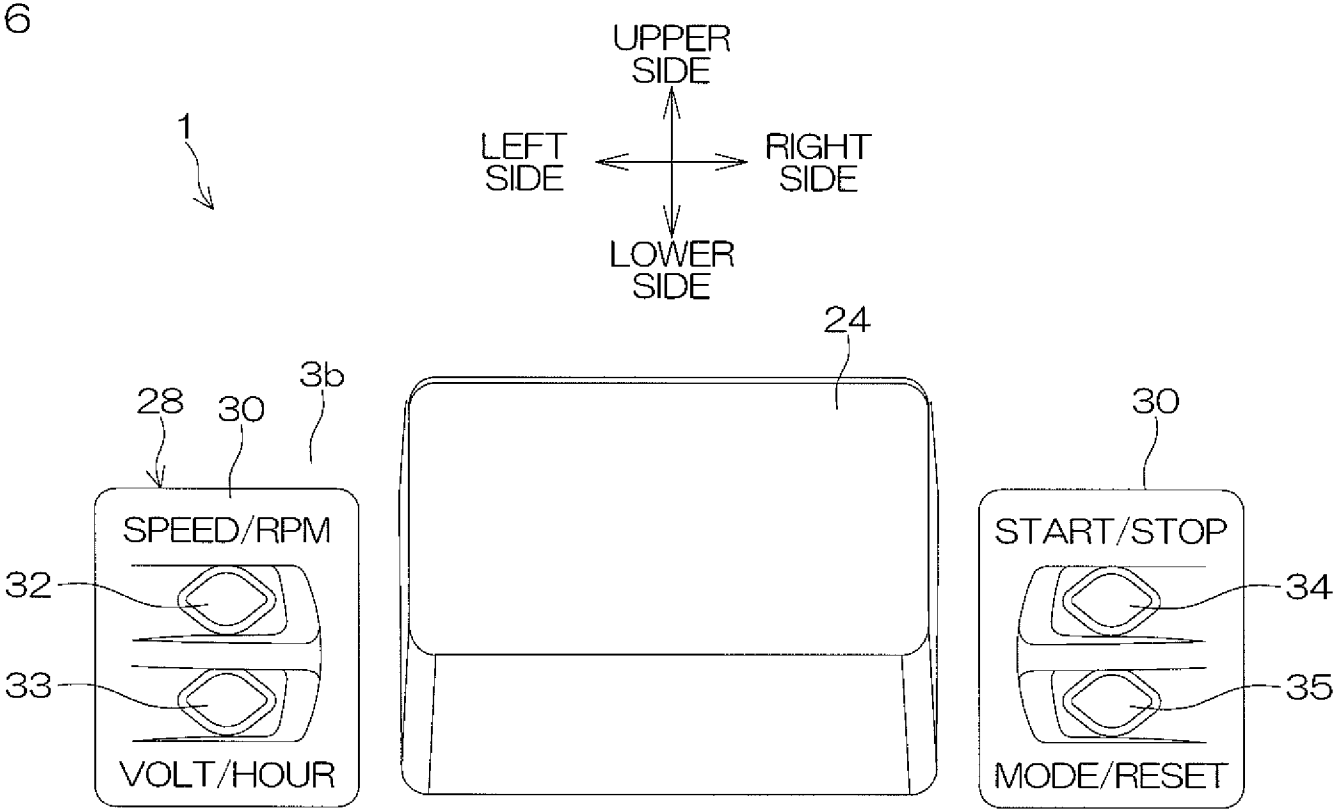
FIG. 6 is a plan view for describing switches according to the first preferred embodiment of the present invention.
Figure 7:
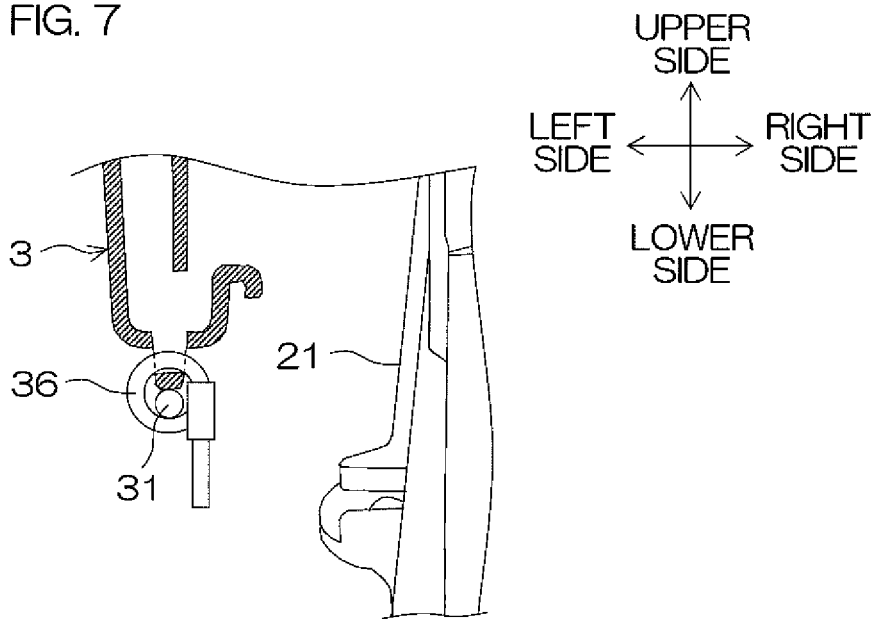
FIG. 7 is a partial sectional view of a portion of the personal watercraft taken along line VII-VII in FIG. 4.

FIG. 4 is a view for describing an internal structure of the personal watercraft 1 according to the first preferred embodiment of the present invention. FIG. 5 is a plan view of a portion of the personal watercraft 1 according to the first preferred embodiment of the present invention. FIG. 6 is a plan view for describing switches 30 according to the first preferred embodiment of the present invention. FIG. 7 is a partial sectional view of a portion of the personal watercraft 1 taken along line VII-VII in FIG. 4. FIG. 4 to FIG. 6 show a state in which the tilting operation lever 24 is positioned at the locked position. Hereinafter, FIG. 4 to FIG. 7 will be referred to as is appropriate.

As shown in FIG. 4 and FIG. 5, the personal watercraft 1 includes a display device 28. The display device 28 includes a display portion 29 that displays information of the personal watercraft 1, two switches 30 with which switching operations for switching the display on the display portion 29 are performed, and a wiring 31 that connects the display portion 29 and the switches 30. The display portion 29 is disposed forward relative to the steering shaft 14. The display portion 29 is disposed so as to face backward in a state in which it is inclined with respect to a horizontal plane. Specifically, the display portion 29 is disposed inside a range viewable from a driver sitting on the seat 4.

The display portion 29 includes, for example, a liquid crystal display. The display portion 29 displays information including at least one of, for example, the speed of the personal watercraft 1, the rotational speed of the engine 6, the voltage of the battery, the running time, the running distance, the azimuth direction, the water temperature, and the ambient temperature. Specifically, information that a driver should confirm during running of the personal watercraft 1 is displayed on the display portion 29. A driver can select information to be displayed on the display portion 29 by operating the switches 30.

In detail, as shown in FIG. 6, the left switch 30 includes a first upper operation portion 32 and a first lower operation portion 33 aligned up and down. When the first upper operation portion 32 is operated, the display on the display portion 29 switches from, for example, the speed of the personal watercraft 1 to the rotational speed of the engine 6 or from the rotational speed of the engine 6 to the speed of the personal watercraft 1. When the first lower operation portion 33 is operated, the display on the display portion 29 is switched from, for example, the voltage of the battery to the running time or from the running time to the voltage of the battery.

As shown in FIG. 6, the right switch 30 includes a second upper operation portion 34 and a second lower operation portion 35 aligned up and down. When the second upper operation portion 34 is operated, measurement of the running distance is started or stopped, for example. When the second lower operation portion 35 is operated, the mode of the display portion 29 is switched and any of the azimuth direction, the water temperature, and the ambient temperature is displayed, for example. Further, when the second lower operation portion 35 is pressed for a longer period of time (the state in which the second lower operation portion 35 is pressed is kept for several seconds), the running distance is reset and returned to zero.

As shown in FIG. 5, the seat 4 includes a central front end 4*a* that is the front end of the center of the seat 4 in the width direction of the personal watercraft 1. The tilting operation lever 24 is disposed rearward relative to the steering shaft 14 and forward relative to the central front end 4*a*. The two switches 30 are disposed on the lateral sides of the tilting operation lever 24 positioned at the locked position. Therefore, the two switches 30 are disposed rearward relative to the steering shaft 14 and forward relative to the central front end 4*a*. The two switches 30 are disposed on the surface 3*b* of the deck 3 rearward relative to the steering shaft 14 and forward relative to the central front end 4*a*. The two switches 30 may be disposed on only the right side or only the left side of the tilting operation lever 24 or may be disposed on both the right and left sides of the tilting operation lever 24.

As shown in FIG. 5, in the first preferred embodiment, the two switches 30 are disposed on both the right and left sides of the tilting operation lever 24. In detail, the tilting operation lever 24 is disposed at the central portion of the personal watercraft 1 in the width direction. The two switches 30 are disposed bilaterally symmetrical to each other on both the right and left sides of the tilting operation lever 24. As shown in FIG. 4, the two switches 30 and the tilting operation lever 24 are disposed at the rear of the steering handle 5. The steering handle 5 is turned to the right and left around the steering shaft 14 from the straight-running position (the position shown in FIG. 5). The straight-running position is a position at which the personal watercraft 1 runs straight. As shown in FIG. 5, the two switches 30 and the tilting operation lever 24 are disposed below the steering handle 5 at the straight-running position. Specifically, the two switches 30 and the tilting operation lever 24 are disposed below the steering handle 5.

As shown in FIG. 5, the switches 30 are, for example, rectangular in a plan view. The switches 30 are disposed so as to face upward. As shown in FIG. 4, the switches 30 are preferably disposed along a horizontal plane. The switches 30 may be attached to the deck 3 in a posture inclined with respect to a horizontal plane, or may be attached to the deck 30 in a horizontal posture. The wiring 31 extends downward from the switches 30. The wiring 31 is disposed inside the deck 3. Therefore, the wiring 31 is covered by the deck 3. As shown in FIG. 4 and FIG. 7, the wiring 31 is attached to the deck 3 by a band 36 on the lateral side of the housing 21. As shown in FIG. 7, the wiring 31 is not in contact with the housing 21. That is, the wiring 31 is covered by the deck 3 in a state that the wiring 21 is not in contact with the movable portions 37 of the personal watercraft that are movable with respect to the deck 3. In the first preferred embodiment, the movable portions 37 preferably include, for example, the steering handle 5, the steering shaft 14, and the steering column 15.

As shown in FIG. 5, the deck 3 further includes a visor 38 disposed forward relative to the steering handle 5, and a pair of mirror holders 39 disposed on both the right and left sides of the visor 38. The visor 38 is inclined so as to extend lower as it extends forward (refer to FIG. 1). The rear end portion of the visor 38 is disposed rearward relative to the upper end portion of the display portion 29. The display portion 29 is covered by the visor 38. The personal watercraft 1 includes two mirrors 40 disposed at an interval in the right-left direction. The display portion 29 is disposed between the two mirrors 40. The two mirrors 40 are held by the two mirror holders 39, respectively. Each mirror holder 39 is removable.

As shown in FIG. 4, the deck 3 further includes an article storing portion 41 opened upward and a lid 42 that opens and closes the article storing portion 41. The article storing portion 41 is disposed rearward relative to the switches 30 and forward relative to the central front end 4*a*. The article storing portion 41 defines an article storing space S1 recessed to be lower than the surface 3*b* of the deck 3. The lid 42 is disposed above the article storing portion 41. The opening of the article storing portion 41 is covered by the lid 42. The front end portion of the lid 42 is joined to the article storing portion 41 by a hinge 43. The lid 42 is turnable up and down around the hinge 43 between an opening position at which the article storing portion 41 is opened and a closing position (position shown in FIG. 4) at which the article storing portion 41 is closed. The two switches 30 and the tilting operation lever 24 are disposed along the front end portion of the lid 42. The two switches 30 and the tilting operation lever 24 are disposed rearward relative to the steering handle 5 and forward relative to the article storing portion 41. The front end portion of the lid 42 is disposed below the rear end portion of the steering handle 5.

Figure 8:
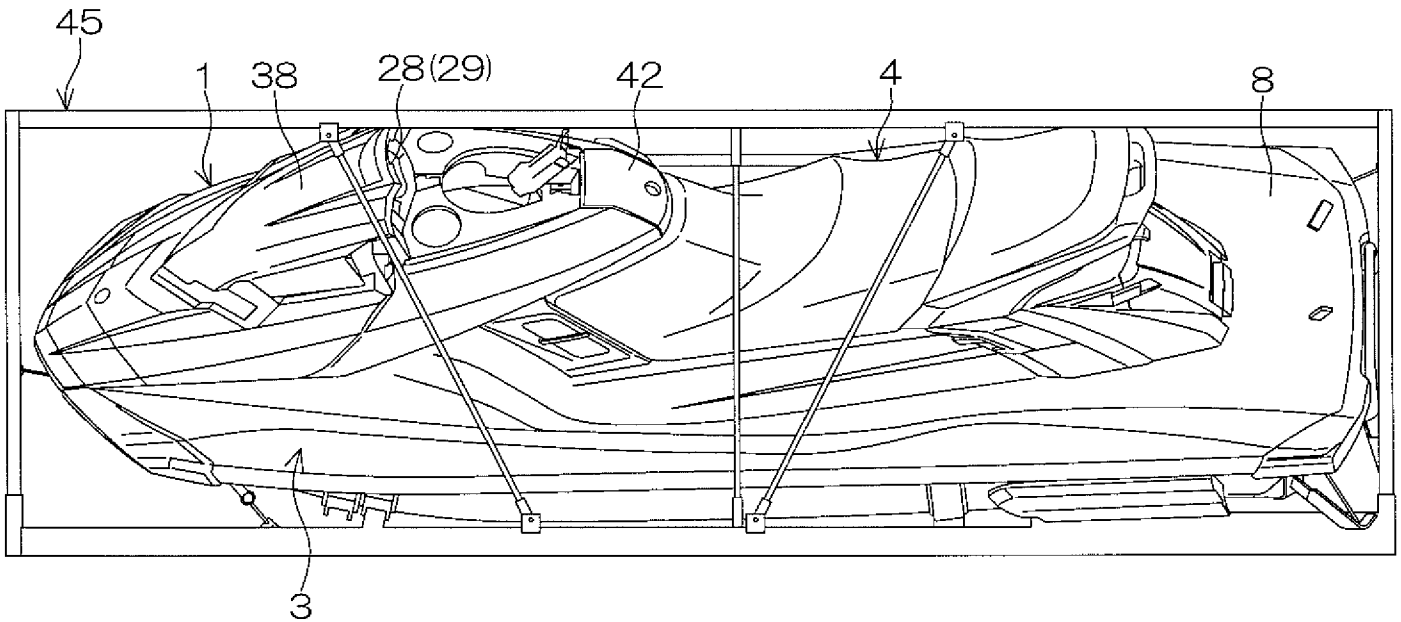
FIG. 8 is a side view showing a state in which the personal watercraft according to the first preferred embodiment of the present invention is disposed inside a packaging frame.
Figure 9:
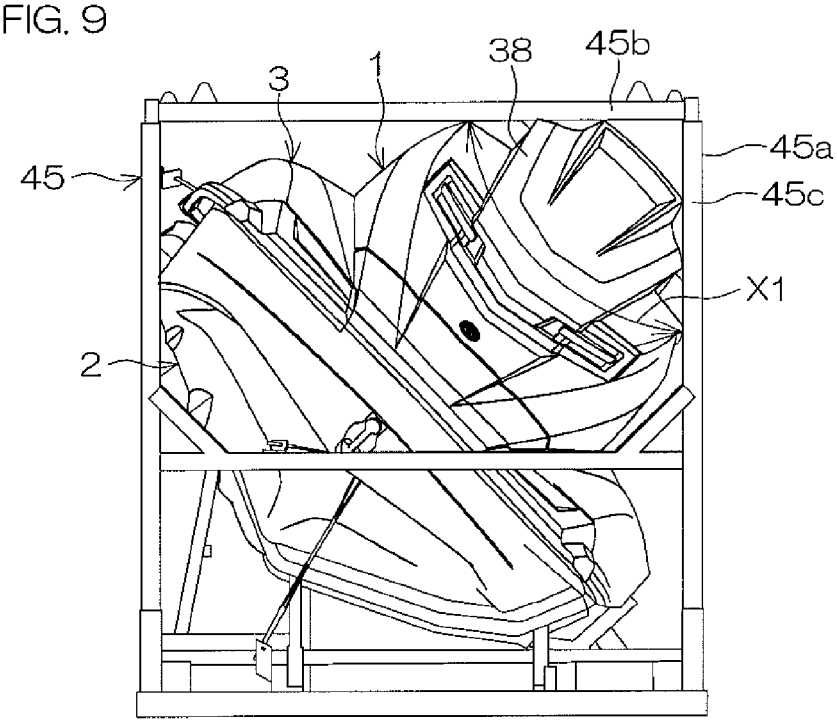
FIG. 9 is a front view showing a state in which the personal watercraft according to the first preferred embodiment of the present invention is disposed inside a packaging frame.
Figure 10:
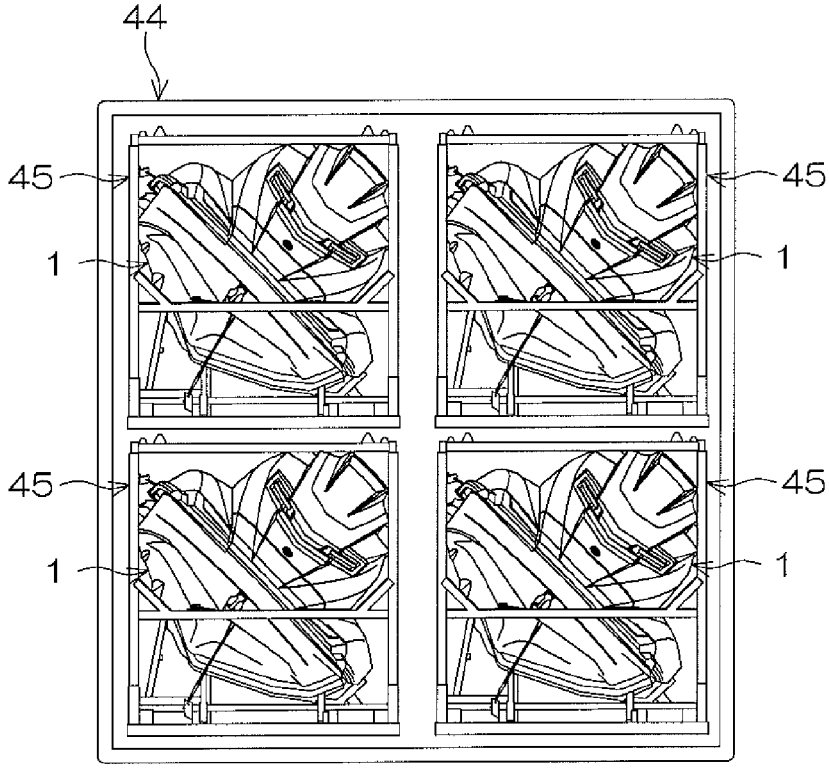
FIG. 10 is a front view showing a state in which a plurality of packaging frames according to the first preferred embodiment of the present invention are housed inside a container.

FIG. 8 is a side view showing a state in which the personal watercraft 1 according to the first preferred embodiment of the present invention is disposed inside a packaging frame 45. FIG. 9 is a front view showing a state in which the personal watercraft 1 according to the first preferred embodiment of the present invention is disposed inside the packaging frame 45. FIG. 10 is a front view showing a state in which a plurality of packaging frames 45 according to the first preferred embodiment of the present invention are housed in a container 44.

When a plurality of personal watercrafts 1 are transported, these personal watercrafts 1 are transported in a state in which they are housed in a rectangular parallelepiped container 44 in some cases. In detail, as shown in FIG. 8 and FIG. 9, for example, each personal watercraft 1 is disposed inside a rectangular parallelepiped packaging frame 45. Then, as shown in FIG. 10, a plurality of packaging frames 45 housing the personal watercrafts 1 are housed in a rectangular parallelepiped container 44, and this container 44 is transported by a transportation device such as a vessel.

The size of the container 44 is normally determined. Therefore, the size of the packaging frame 45 is set so that, for example, four packaging frames 45 aligned up and down and right and left can be housed in one container 44 for effective use of the space inside the container 44. Therefore, when the width of the personal watercraft 1 is larger than the width of the packaging frame 45, in order to house the personal watercraft 1 inside the packaging frame 45, the personal watercraft 1 is disposed inside the packaging frame 45 in a state in which the personal watercraft 1 is inclined in the front-rear direction and/or the right-left direction with respect to the reference posture. Further, the personal watercraft 1 may be disposed inside the packaging frame 45 in a state in which a portion of the components of the personal watercraft 1 is removed.

In the first preferred embodiment, the personal watercraft 1 is housed inside the packaging frame 45 in a predetermined packaging state. That is, as shown in FIG. 8, the personal watercraft 1 is disposed inside the packaging frame 45 in a state in which the personal watercraft is inclined in the right-left direction with respect to the reference posture. Further, as shown in FIG. 9, the personal watercraft 1 is disposed inside the packaging frame 45 in a state in which the personal watercraft is inclined in the front-rear direction with respect to the reference posture so that the stem moves downward. Further, the personal watercraft 1 is disposed inside the packaging frame 45 in a state in which the steering handle 5 and the two mirror holders 39 are removed. Specifically, the packaging state according to the first preferred embodiment is, for example, a state in which the personal watercraft 1 is inclined in the front-rear direction and left-right direction with respect to the reference posture and a portion of the components of the personal watercraft 1 is removed.

As shown in FIG. 9, the visor 38 has a shape extending along the corner portion 45*a* of the packaging frame 45 when the personal watercraft 1 in a packaging state in which the personal watercraft is housed inside the rectangular parallelepiped packaging frame 45 is viewed from the front. Specifically, when the personal watercraft 1 is in the packaging state in which the personal watercraft is housed inside the packaging frame 45 and is viewed from the front, the visor 38 is positioned inside the corner portion 45*a* of the packaging frame 45. When the personal watercraft 1 is in the packaging state in which the personal watercraft is housed inside the packaging frame 45 and is viewed from the front, the visor 38 is inside the range X1 of 90 degrees defined by the upper portion 45*b* and the side portion 45*c* of the packaging frame 45. Further, when the personal watercraft 1 is in the packaging state in which the personal watercraft is housed inside the packaging frame 45 and is viewed from the front, the visor 38 is along the corner portion 45*a* of the packaging frame 45. Accordingly, the space inside the packaging frame 45 is effectively used, and the personal watercraft 1 is efficiently housed inside the packaging frame 45.

As described above, in the first preferred embodiment of the present invention, the display portion 29 that displays information of the personal watercraft 1 is disposed forward relative to the steering shaft 14. Therefore, the display portion 29 is disposed at a position easily viewable from a driver sitting on the seat 4. Accordingly, viewing ease of the display portion 29 is secured. The switches 30 that operate the display portion 29 are disposed rearward relative to the steering shaft 14. Therefore, as compared with the case in which the switches 30 are disposed on the lateral side of the display portion 29, the width of the display portion 29 can be reduced. Accordingly, even in the case in which the personal watercraft 1 is housed inside the packaging frame 45 in a state in which the personal watercraft 1 is inclined in the left-right direction with respect to the reference posture, the personal watercraft 1 can be efficiently housed inside the packaging frame 45. Further, the switches 30 are disposed on the surface 3*b* of the deck 3 forward relative to the central front end 4*a*. Specifically, the switches 30 are disposed by the hand of a driver. Therefore, a driver can easily access the switches 30.

In the first preferred embodiment, the article storing portion 41 is disposed rearward relative to the switches 30 and forward relative to the central front end 4*a*. Specifically, the article storing portion 41 is disposed rearward relative to the steering shaft 14. Therefore, a dead space is defined between the steering shaft 14 and the article storing portion 41. The switches 30 are disposed in the dead space defined on the deck 3. Therefore, the dead space is effectively used. Further, the article storing portion 41 is disposed forward relative to the central front end 4*a*, so that a driver can easily access the article storing portion 41.

In the first preferred embodiment, the wiring 31 is preferably covered by the deck 3 in a state that it does not contact with the movable portions 37 that are movable with respect to the deck 3. The wiring 31 and the movable portions 37 are not in contact with each other, so that the movable portions 37 can be prevented from being damaged by rubbing with the wiring 31. Further, the wiring 31 is attached to the deck 3. Further, as described above, the switches 30 are disposed on the surface 3*b* of the deck 3. Specifically, both of the wiring 31 and the switches 30 are attached to the deck 3. Therefore, when the movable portions 37 such as the steering handle 5 are removed from the personal watercraft 1, the wiring 31 does not need to be removed. Therefore, when the personal watercraft 1 is transported in the state in which the steering handle 5 is removed, the wiring 31 does not need to be removed. Accordingly, processes required to transport the personal watercraft 1 can be reduced.

Further, as described above, the switches 30 are disposed on the surface of the deck 3. Therefore, a driver looks down on the switches 30. In the first preferred embodiment, the switches 30 preferably are disposed so as to face upward. Therefore, a driver can easily look at the switches 30 and easily operate the switches 30.

In the first preferred embodiment, the steering handle 5 is preferably arranged to be turnable up and down around the tilt shafts 20, and the tilting operation lever 24 that moves between the locked position and the unlocked position is disposed rearward relative to the steering shaft 14 and forward relative to the central front end 4*a*. The switches 30 are disposed on the lateral sides of the tilting operation lever 24. Specifically, the switches 30 are disposed in the dead space on the lateral sides of the tilting operation lever 24. Accordingly, the dead space is effectively used.

In the first preferred embodiment, the front end portion of the lid 42 is preferably disposed below the rear end portion of the steering handle 5, and the two switches 30 and the tilting operation lever 24 are preferably disposed below the steering handle 5. For example, when the front end portion of the lid 42 is close to the steering shaft 14, the steering handle 5 is positioned above the lid 42, so that when a rider opens the lid 42, the lid 42 interferes with the steering handle 5 and the lid 42 cannot be opened widely. Therefore, in order to make it possible for a rider to open the lid 42 widely, the front end portion of the lid 42 is disposed below the rear end portion of the steering handle 5. Therefore, a fixed space is provided between the lid 42 and the steering shaft 14, and a dead space is provided between the lid 42 and the steering shaft 14. The two switches 30 and the titling operation lever 24 are disposed in this dead space, that is, disposed below the steering handle 5. Accordingly, the dead space between the lid 42 and the steering shaft 14 is effectively used.

The preferred embodiments of the present invention are described above, and the present invention is not limited to the contents of the above-described preferred embodiments, and can be variously changed within the scope of claims.

For example, the preferred embodiments described above describe a case in which a tilt mechanism 16 that adjusts the position of the steering handle 5 by turning the steering handle 5 around the tilt shafts 20 is preferably provided. However, instead of the tilt mechanism 16, a telescopic mechanism that adjusts the position of the steering handle 5 by moving the steering handle 5 in the axial direction of the steering shaft 14 may be provided. Alternatively, both of the tilt mechanism 16 and the telescopic mechanism may not be provided in the personal watercraft.

The preferred embodiments described above describe a case in which two switches 30 are preferably provided. However, the number of switches 30 to be provided in the personal watercraft 1 may be one, or may be three or more.

The preferred embodiments described above describe a case in which the switches 30 are preferably disposed rearward relative to the steering handle 5 and forward relative to the article storing portion 41. However, the switches 30 may be disposed on the upper surface of the lid 42 and above the article storing portion 41. Specifically, the surface of the deck 3 on which the switches 30 are disposed may be the upper surface of the lid 42.

Figure 11:
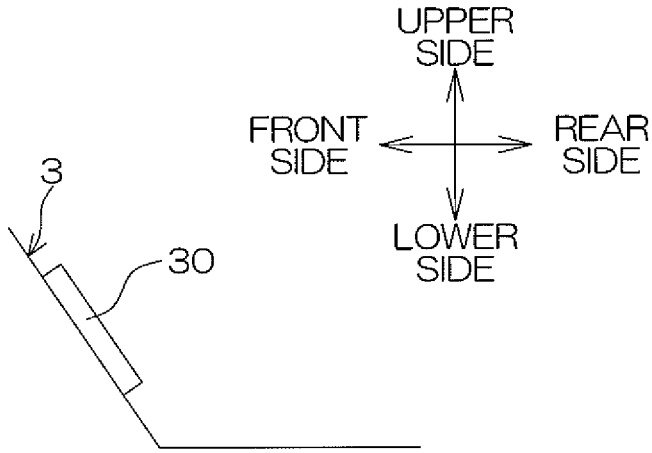
FIG. 11 is a schematic view for describing disposition of a switch according to a second preferred embodiment of the present invention.

The preferred embodiments described above describe a case in which the switches 30 are preferably disposed so as to face upward. However, the switches 30 may be disposed so as to face backward. In detail, as shown in FIG. 11, the switches 30 may be disposed on an inclined portion provided on the surface of the deck 3. The switches 30 may be disposed on, for example, a vertical portion provided on the surface of the deck 3 although this is not shown.

The present application corresponds to Japanese Patent Application No. 2011-006908 filed in the Japan Patent Office on Jan. 17, 2011, and the entire disclosure of this application is incorporated herein by reference.

While preferred embodiments of the present invention have been described above, it is to be understood that variations and modifications will be apparent to those skilled in the art without departing from the scope and spirit of the present invention. The scope of the present invention, therefore, is to be determined solely by the following claims.

What is claimed is:

1. A personal watercraft comprising:

a hull;

a deck disposed above the hull;

a steering handle disposed above the deck;

a steering shaft arranged to extend downward from the steering handle;

a seat including a central front end located at a front end of a center of the seat in a width direction, the seat supported on the deck rearward relative to the steering shaft; and a display device including a display portion disposed forward relative to the steering shaft, and a switch arranged to operate the display portion, the switch disposed rearward relative to the steering shaft and forward relative to the central front end of the seat, at least a portion of the switch disposed leftward relative to a right end of the display portion and rightward relative to a left end of the display portion in a plan view of the personal watercraft.

2. The personal watercraft according to claim 1, wherein the deck includes an article storing portion disposed rearward relative to the switch and forward relative to the central front end of the seat.

3. The personal watercraft according to claim 1, wherein the display device further includes wiring arranged to connect the display portion and the switch, the wiring is covered by the deck in a state that the wiring is not in contact with movable portions of the personal watercraft that are movable with respect to the deck, and the wiring is attached to the deck.

4. The personal watercraft according to claim 1, further comprising a visor arranged to cover the display portion, the visor having a shape arranged to extend along a corner portion of a rectangular parallelepiped packaging frame when the personal watercraft is in a packaging state in which the personal watercraft is housed in the packaging frame and is viewed from a front of the personal watercraft.

5. The personal watercraft according to claim 1, wherein the switch is disposed so as to face upward or backward.

6. The personal watercraft according to claim 1, wherein the steering handle is arranged to turn up and down around a tilt shaft, and the personal watercraft further comprises:

a tilting operation lever arranged to move between a locked position in which turning of the steering handle around the tilt shaft is locked and an unlocked position in which a lock of the steering handle around the tilt shaft is released, the tilting operation lever disposed rearward relative to the steering shaft and forward relative to the central front end of the seat; and the switch is disposed on a lateral side of the tilting operation lever.

7. A personal watercraft comprising:

a hull;

a deck disposed above the hull;

a steering handle disposed above the deck;

a steering shaft arranged to extend downward from the steering handle;

a seat including a central front end located at a front end of a center of the seat in a width direction, the seat supported on the deck rearward relative to the steering shaft; and a display device including a display portion disposed forward relative to the steering shaft, and a switch arranged to operate the display portion, the switch disposed rearward relative to the steering shaft and forward relative to the central front end of the seat, an entirety of the switch disposed under the steering handle such that the switch and the steering handle overlap with each other in a plan view of the personal watercraft.

8. A personal watercraft comprising:

a hull;

a deck disposed above the hull;

a steering handle disposed above the deck;

a steering shaft arranged to extend downward from the steering handle;

a seat including a central front end located at a front end of a center of the seat in a width direction, the seat supported on the deck rearward relative to the steering shaft; and a display device including a display portion disposed forward relative to the steering shaft, a switch arranged to operate the display portion, the switch disposed rearward relative to the steering shaft and forward relative to the central front end of the seat, and wiring arranged to connect the display portion and the switch, the wiring being covered by the deck in a state that the wiring is not in contact with movable portions of the personal watercraft that are movable with respect to the deck, the wiring being attached to the deck.

9. A personal watercraft comprising:

a hull;

a deck disposed above the hull;

a steering handle disposed above the deck;

a steering shaft arranged to extend downward from the steering handle;

a seat including a central front end located at a front end of a center of the seat in a width direction, the seat supported on the deck rearward relative to the steering shaft;

a display device including a display portion disposed forward relative to the steering shaft, and a switch arranged to operate the display portion, the switch disposed rearward relative to the steering shaft and forward relative to the central front end of the seat; and a visor arranged to cover the display portion, the visor having a shape arranged to extend along a corner portion of a rectangular parallelepiped packaging frame when the personal watercraft is in a packaging state in which the personal watercraft is housed in the packaging frame and is viewed from a front of the personal watercraft.

10. The personal watercraft according to claim 1, wherein the switch is disposed on a surface of the deck.

* * * * *